US007413619B2

(12) United States Patent
Kawahata et al.

(10) Patent No.: US 7,413,619 B2
(45) Date of Patent: Aug. 19, 2008

(54) COPPER ALLOY

(75) Inventors: Toshikazu Kawahata, Kanagawa (JP); Takefumi Ito, Tokyo (JP); Takenori Sone, Tokyo (JP); Yumiko Iwashita, Kanagawa (JP); Toshihiro Kurita, Kanagawa (JP)

(73) Assignees: Mitsubishi Denki Kabushiki Kaisha, Tokyo (JP); Mitsubishi Electric Metecs Co., Ltd., Sagamihara, Kanagawa (JP)

( * ) Notice: Subject to any disclaimer, the term of this patent is extended or adjusted under 35 U.S.C. 154(b) by 0 days.

(21) Appl. No.: 11/357,153

(22) Filed: Feb. 21, 2006

(65) Prior Publication Data

US 2006/0201591 A1 Sep. 14, 2006

(30) Foreign Application Priority Data

Mar. 11, 2005 (JP) ..... 2005-068761

(51) Int. Cl.
*C22C 9/06* (2006.01)

(52) U.S. Cl. ..... 148/435; 420/485; 420/486; 420/487; 420/488

(58) Field of Classification Search ..... 148/435; 420/485, 486, 487, 488
See application file for complete search history.

(56) References Cited

U.S. PATENT DOCUMENTS

| | | | | |
|---|---|---|---|---|
| 5,124,124 | A * | 6/1992 | Ohashi et al. | 420/473 |
| 5,675,883 | A | 10/1997 | Gaag et al. | |
| 5,833,920 | A | 11/1998 | Nakanishi et al. | |
| 2002/0127133 | A1 | 9/2002 | Usami et al. | |

FOREIGN PATENT DOCUMENTS

| | | | |
|---|---|---|---|
| DE | 1 278 110 | | 9/1973 |
| JP | 63-210262 | A | 8/1988 |
| JP | 3-10036 | A | 1/1991 |
| JP | 10-152736 | | 6/1998 |
| JP | 10-152737 | | 6/1998 |
| JP | 2001-49369 | | 2/2001 |
| JP | 2002-38228 | | 2/2002 |
| JP | 2004156115 | * | 6/2004 |

* cited by examiner

*Primary Examiner*—Sikyin Ip
(74) *Attorney, Agent, or Firm*—Leydig, Voit & Mayer, Ltd.

(57) ABSTRACT

Raw materials for a copper alloy are melted in a high frequency smelter and cast, and milling, rolling, and annealing are carried out. Then, rolling is again carried out. Thereafter, the materials are heated at a temperature of 900° C. for one minute and are quenched in water, to be solution treated. Subsequently, the materials are heated at a temperature of 500° C. for five hours for aging, and then are cooled at a cooling rate in a range of 10 to 50° C. per hour until the materials are cooled to a temperature of 380° C.

2 Claims, 1 Drawing Sheet

COPPER ALLOY

BACKGROUND OF THE INVENTION

1. Field of the Invention

The present invention relates to a copper alloy and a method of manufacturing the same, and more particularly to a copper alloy used for an electronic component and a method of manufacturing the same.

2. Description of the Background Art

In recent years, a device to which a lead frame or a connector is to be applied has been more miniaturized and multifunctional, and also a packing density has become higher. Accordingly, a lead frame on which an integrated circuit (IC) is mounted has become thinner, the number of pins serving as terminals of a connector used in an electronic device has increased, and the pitch between the pins has become smaller. For those reasons, there is an increasing demand for reliable connection in packaging.

More specifically, miniaturization of an electronic component requires improvement of strength of a metal material used for the electronic component. Also, as a cross-sectional area of a terminal becomes smaller because of increase in the number of pins and reduction in the pitch between the pins, a metal material for an electronic component having more excellent electrical conductivity is required.

To meet the foregoing requirements, according to the conventional practices, an alloy formed by adding beryllium (Be) to copper (Cu) was employed. Such alloy has both tensile strength equal to or higher than 800 MPa (mega pascal) and conductivity equal to or higher than 50% IACS (international annealed copper standard).

However, considering the recent environmental issues, a current trend is to avoid use of the above-mentioned conventional material containing beryllium. Thus, an attention is now being drawn to a Cu—Ni—Si alloy (so-called Corson alloy) in place of the conventional material containing beryllium.

It is known that a Cu—Ni—Si alloy is a precipitation hardened alloy which is hardened by virtue of micro crystals of a $Ni_2Si$ intermetallic compound which are dispersed and precipitated out in Cu and serve as barriers against transformation. Many reports about efforts to increase strength and conductivity by controlling an amount of Ni (nickel) and Si (silicon) to be added or a ratio of Ni to Si have so far been made.

For example, Japanese Patent Application Laid-Open No. 10-152736 (which will hereinafter be referred to as "JP No. 10-152736") discloses in FIG. 2 a technique of forming a copper alloy having conductivity equal to or higher than 50% IACS and tensile strength equal to or higher than 700 MPa by carrying out cold rolling and aging on a raw material containing Ni of 1.0 to 5.0 percent by mass, Si of 0.2 to 1.0 percent by mass, Zn (zinc) of 0.3 to 0.5 percent by mass, and P (phosphorus) of 0.03 to 0.3 percent by mass, in which a mass ratio of Ni to Si is controlled to be in a range of 4.5 to 5.5.

Also, Japanese Patent Application Laid-Open No. 2001-49369 (which will hereinafter be referred to as "JP No. 2001-49369") discloses in FIG. 1 a technique of forming a copper alloy containing Ni of 1.0 to 4.8 percent by mass, Si of 0.2 to 1.4 percent by mass, and inclusions each being equal to or smaller than 10 μm in size, in which alloy the number of the inclusions each being in a range of five to ten μm in size is smaller than $50/mm^2$ per section of the copper alloy taken along a direction of rolling.

However, according to the above-described technique disclosed in JP No. 10-152736, though the formed copper alloy has conductivity higher than 50% IACS, the tensile strength thereof is approximately 740 MPa ($N/mm^2$) at the highest. On the other hand, according to the above-described technique disclosed in JP 2001-49369, though the tensile strength of 770 MPa ($N/mm^2$) is achieved, a copper alloy having conductivity higher than 50% IACS cannot be formed.

As is made clear from the above description, it was difficult to obtain a copper alloy which does not contain Be and has both tensile strength equal to or higher than 800 MPa and conductivity higher than 50% IACS by the conventional techniques.

SUMMARY OF THE INVENTION

It is an object of the present invention to provide a copper alloy which does not contain Be and has tensile strength equal to or higher than 800 MPa, conductivity higher than 50% IACS, and excellent plating adhesion.

A copper alloy according to the present invention includes Ni of 2.2 to 3.2 percent by mass, Si of 0.4 to 0.8 percent by mass, Cu, and an unavoidable impurity. A mass ratio of Ni to Si is in a range of 4.0 to 5.5, a size of an inclusion precipitated out in the copper alloy is equal to or smaller than 2 μm, and a total volume of the inclusion which is 0.1 to 2 μm in size is equal to or smaller than 0.5% of a total volume of the copper alloy.

In the above-described copper alloy, an optimal amount of $Ni_2Si$ compounds are precipitated out in Cu and an amount of elements including Ni and Si which remain in a solid solution state in Cu is reduced. Thus, it is possible to obtain a copper alloy having tensile strength equal to or higher than 800 MPa and conductivity higher than 50% IACS.

A method of manufacturing a copper alloy according to the present invention includes the steps of: (a) melting and casting a raw material for the copper alloy, to form an alloy material; (b) solution treating the alloy material at a temperature in a range of 700 to 950° C.: (c) carrying out aging on the solution treated alloy material by heating the solution treated alloy material at a temperature in a range of 400 to 600° C. for two to eight hours; and (d) cooling the alloy material after aging is carried out at a cooling rate in a range of 10 to 50° C. per hour until the alloy material is cooled to a temperature of at least 380° C.

According to the above-described method of manufacturing a copper alloy, solution treatment of the alloy material at a temperature in the range of 700 to 950° C. causes the copper alloy to become a uniform solid solution, and subsequently aging is carried out at a temperature in the range of 400 to 600° C. for two to eight hours. After aging, the alloy material is cooled at a cooling rate in the range of 10 to 50° C. per hour until the alloy material is cooled to 380° C. As a result, a sufficient amount of fine $Ni_2Si$ compounds can be precipitated out while preventing the precipitated $Ni_2Si$ compounds from becoming coarse, and also an amount of elements including Ni and Si which remain in a solid state in Cu can be reduced. Consequently, it is possible to obtain a copper alloy having tensile strength equal to or higher than 800 MPa ($N/mm^2$) and conductivity equal to or higher than 50% IACS.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred Embodiments

Figure 1:
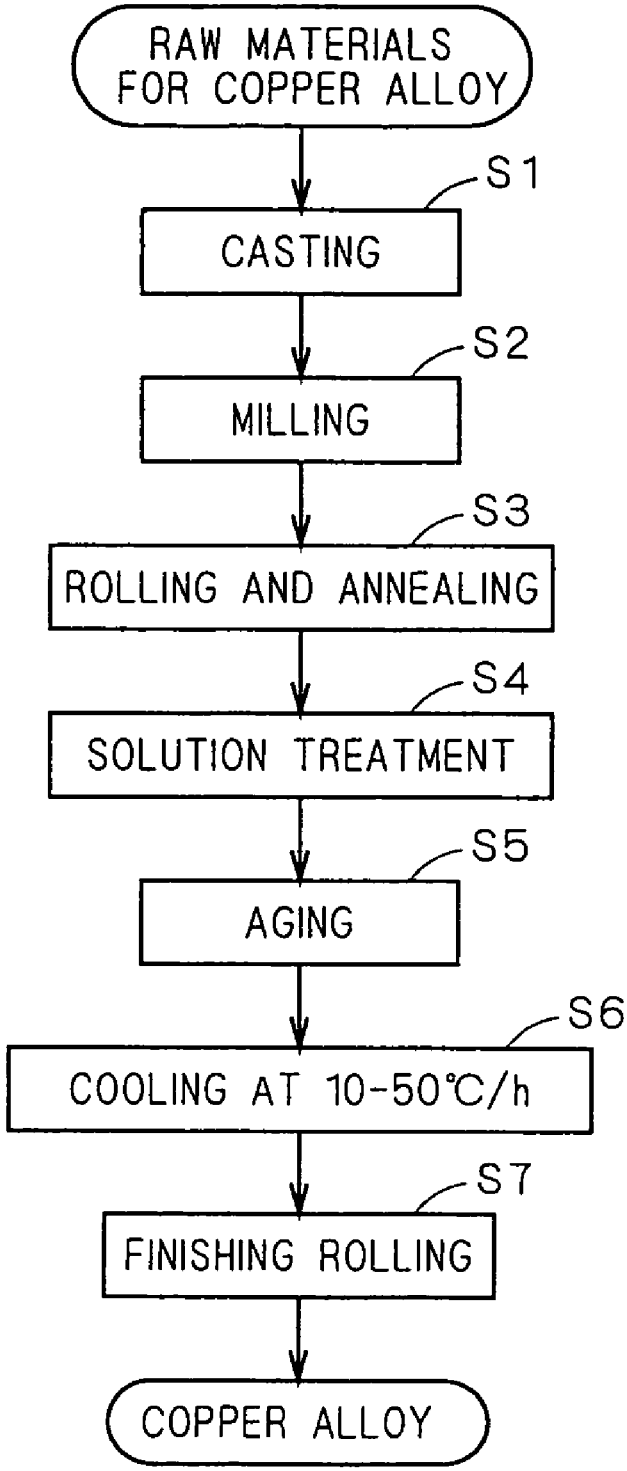
FIG. 1 is a flow chart for explaining a method of manufacturing a copper alloy according to the present invention.

<A. Best Composition for Achieving Desired Values>

First of all, a composition of a copper alloy for achieving desired values of the present invention, that is, tensile strength equal to or higher than 800 MPa and conductivity higher than 50% IACS, will be described.

In short, a copper alloy which is composed principally of copper and allows for the desired values can be obtained by causing the copper alloy to contain Ni of 2.2 to 3.2 percent by mass and Si of 0.4 to 0.8 percent by mass and controlling such that the mass ratio of Ni to Si is in a range of 4.0 to 5.5, the size of each of inclusions precipitated out in the copper alloy is equal to or smaller than 2 μm, and the total volume of the inclusions each of which is in a range of 0.1 to 2.0 μm in size is equal to or smaller than 0.5% of the total volume of the copper alloy.

It is noted that the term "inclusion" is a generic name for a coarse precipitated particle which is produced during manufacture of the copper alloy. Specific examples thereof are an oxide produced in response to reaction with the atmosphere, an undesired Ni—Si compound phase other than a $Ni_2Si$ microcrystal, a particle caused due to a Cu—Ni—Si alloy phase, and so on.

As each of the above-described inclusions becomes larger in size, or as the volume of the inclusions increases, the strength and the plating adhesion of the copper alloy are lowered. In order to suppress the inclusions, it is necessary to control the amount of Ni and Si to be suitable. When the total amount of Ni and Si is larger than the suitable amount, a compound phase or an alloy phase produced due to excess Ni and Si which fail to become into a solid solution state as $Ni_2Si$ is precipitated out, to degrade the properties. Also, an unsuitable ratio between Ni and Si causes a phase other than proper $Ni_2Si$ crystalline phases to be precipitated out as an inclusion, to degrade the properties. Further, when the amount of Ni and Si is smaller than the suitable amount, $Ni_2Si$ crystalline phases are insufficiently produced, to fail to achieve high strength.

The inventors of the present invention have found that when a copper alloy contains Ni of 2.2 to 3.2 percent by mass and Si of 0.4 to 0.8 percent by mass and the mass ratio of Ni to Si is in a range of 4.0 to 5.5, the size of each of the inclusions is equal to or smaller than 2 μm and the total volume of the inclusions each of which is in a range of 0.1 to 2.0 μm in size is equal to or smaller than 0.5% of the total volume of the copper alloy, to thereby achieve high tensile strength, high conductivity, and excellent plating adhesion.

It is noted that if each of the inclusions is spherical, a diameter of each of the inclusions is employed as the size of each of the inclusions, and if each of the inclusions is oval or rectangular, a shorter diameter or a shorter side of each of the inclusions is employed as the size of each of the inclusions.

Also, the volume ratio of the inclusions to the copper alloy is obtained by polishing a section of the copper alloy and observing the polished section using a scanning electron microscope. For this observation, a region having a predetermined depth (approximately 1 μm, for example) or greater from the uppermost surface of a sample is observed. Then, a sum of respective areas of the inclusions in the observed region is calculated by image processing and divided by an area of the observed region. In this manner, the volume ratio of the inclusions to the copper alloy can be obtained.

For instance, five portions each of which is approximately 100 square microns are arbitrarily specified as the observed regions, and observed. Then, respective area ratios of the inclusions to the five observed regions are averaged, and a resultant value is employed as the volume ratio.

As for plating adhesion, excellent plating adhesion can be achieved by controlling the total volume of the inclusions to be equal to or smaller than 0.5% of the volume of the copper alloy. Adding Zn of 0.1 to 1.0 percent by mass, which is effective for suppressing peel of an interface which is likely to be peeled off due to aging after application of an Sn (tin) plating or an Sn alloy plating, to improve plating adhesion, makes it possible to improve the plating adhesion without lowering the strength and the conductivity of the copper alloy.

Additionally, the plating adhesion is evaluated by applying an underlying Cu plating with a thickness of 0.3 μm to the copper alloy, carrying out a reflow process using an Sn plating with a thickness of 1.2 μm on the underlying Cu plating, heating the copper alloy at a temperature of 105° C. for 200 hours, and carrying out a bending test in which the copper alloy is bent into 180 degrees and is again bent in the opposite direction. The plating adhesion is evaluated based on an extent of peel of the plating.

<B. Method of Manufacturing the Copper Alloy>

As described above, JP No. 10-152736 discloses the copper alloy containing Ni of 1.0 to 5.0 percent by mass and Si of 0.2 to 1.0 percent by mass, in which a mass ratio of Ni to Si is controlled to be in a range of 4.5 to 5.5. Though the composition of the copper alloy according to the present invention may be covered by the foregoing numerical values disclosed in JP No. 10-152736, the technique disclosed in JP No. 10-152736 cannot achieve the above-cited desired values of the present invention.

The reason is that JP No. 10-152736 neither considers the inclusions precipitated out in the copper alloy nor has a technical concept of optimizing the size of each of the inclusions and the total volume of the inclusions.

On the other hand, while JP No. 2001-49369 shows some considerations for the size of each of the inclusions precipitated out in the copper alloy, the size is not optimized in JP No. 2001-49369 in light of principles of the present invention.

The inventors of the present invention attained a technical concept of improving tensile strength and conductivity by optimizing the size of each of the inclusions and the total volume of the inclusions. Then, the inventors carried out trials based on the foregoing technical concept, to discover the manufacturing method later described in detail.

In a conventional method of manufacturing a copper alloy, a raw material is converted into a plate-shaped ingot by continuous casting, and rolling and milling are carried out on the plate-shaped ingot, so that the plate-shaped ingot is converted into a plate-shaped alloy material. Subsequently, the plate-shaped alloy material is solution treated. For the solution treatment, the plate-shaped alloy material is heated at a temperature in a range of approximately 700 to 950° C. Then, the plate-shaped alloy material is quenched in water, to cause Ni and Si to uniformly exist in a solid state in Cu.

Thereafter, machining such as cold rolling is carried out on the plate-shaped alloy material to introduce the moderate number of crystal defects into the alloy. Subsequently, aging is carried out so that $Ni_2Si$ is precipitated out.

The inventors of the present invention have found that introduction of crystal defects by cold rolling after solution treatment in the conventional method is not important and that it is important to control a cooling rate in cooling after aging to be in a range of 10 to 50° C. per hour until the alloy material is cooled to 380° C., or preferably, 350° C., in order to improve the strength and the electrical conductivity of the copper alloy.

For more details, as solution treatment causes crystal defects to be sufficiently introduced into the copper alloy, it is unnecessary to cause further distortion by cold rolling or the like. On the other hand, as a result of the trials carried out by the inventors of the present invention, it was discovered that controlling the cooling rate in cooling after aging to be in the range of 10 to 50° C. per hour while omitting cold cooling or the like allowed for precipitation of a sufficient amount of $Ni_2Si$ and prevented residual distortion from remaining in the copper alloy.

It was also discovered that if the cooling rate was higher than 50° C. per hour, residual distortion remained in the copper alloy. Because of such distortion, Ni and Si which should have been precipitated out as $Ni_2Si$ remain in a solid solution state, so that neither high strength nor high conductivity can be achieved.

Further, if the cooling rate is lower than 10° C. per hour, an $Ni_2Si$ crystal becomes coarse, to lower the strength.

After the plate-shaped alloy material is cooled to 380° C. after aging, the alloy does not greatly vary in structure during cooling. As such, while it is not particularly required to control the cooling rate after the plate-shaped alloy material has the temperature of 380° C., the cooling rate in the range of 10 to 50° C. per hour may be maintained until the plate-shaped alloy material is cooled to a temperature of approximately 350° C.

Additionally, while a technique for increasing the strength by carrying out rolling and annealing for correcting distortion plural times after aging has been reported, such additional processes of rolling and annealing are not necessarily required because both precipitation of $Ni_2Si$ and correction of distortion can be sufficiently made in the present invention.

<C. Specific Example of Manufacturing Method>

Below, a specific example of the above-described manufacturing method will be described with reference to a flow chart shown in FIG. 1.

First, raw materials (Cu, Ni, Si, and so on) for the copper alloy, each in an amount which corresponds to the above-mentioned proportion in the composition according to the present invention, are prepared. Subsequently, the raw materials for the copper alloy are melted in a high frequency smelter, and cast into a plate-shaped ingot with a thickness of 10 mm (step S1).

Secondly, milling is carried out on the ingot in order to remove scales in a surface of the ingot (step S2).

Then, rolling and annealing are carried out, and subsequently rolling is again carried out, to form a thin plate (serving as an alloy material) with a thickness of 0.38 mm (step S3).

Thereafter, the thin plate is heated at a temperature of 900° C. for one minute, and then is quenched in water, so that the thin plate is solution treated (step S4).

After solution treatment, the solution treated thin plate is heated at a temperature of 500° C. for five hours, for aging (step S5)

After aging is carried out on the thin plate, the thin plate is cooled at a cooling rate in a range of 10 to 50° C. per hour until the thin plate is cooled to a temperature of 380° C. (step S6)

After the thin plate is cooled in the step S6, cold rolling (finishing rolling) is carried out (step S7), so that the thin plate is thinned to a thickness of 0.3 mm, to thereby obtain the copper alloy as desired.

It is noted that the above-cited numerical values for the thicknesses in the respective steps are mere examples. Those thicknesses may be larger than cited above in some cases, and may be smaller than cited above in other cases.

Also, though the heating temperature for solution treatment is 900° C. in the above-described specific example, the heating temperature for solution treatment can be selected from a range of 700 to 950° C. Further, the heating temperature for aging can be selected from a range of 400 to 600° C., and the heating time for aging can be selected from a range of two to eight hours.

Moreover, adding Zn of 0.1 to 1.0 percent by mass, which is effective for improving plating adhesion, to the raw materials for the copper alloy would not lower the strength and the conductivity of the copper alloy manufactured by the above-described manufacturing method.

<D. Respective Properties of Various Alloys Obtained Under Different>Conditions

Respective properties and respective evaluation results of various alloys obtained based on the above-described manufacturing method, but under different conditions, are arranged in the following Table 1.

TABLE 1

| TYPE | No. | PROPORTION IN COMPOSITION (PERCENT BY MASS) Ni | Si | Zn | Ni/Si | COOLING RATE AFTER AGING (° C./h) | VOLUME RATIO OF INCLUSIONS (%) | MAXIMUM SIZE OF INCLUSIONS (μm) | TENSILE STRENGTH (MPa) | CONDUCTIVITY (% IACS) | PLATING ADHESION |
|---|---|---|---|---|---|---|---|---|---|---|---|
| PRESENT INVENTION | 1 | 2.83 | 0.67 | — | 4.22 | 30 | <0.1 | 0.5 | 848 | 51.3 | ○ |
| | 2 | 2.83 | 0.67 | 0.5 | 4.22 | 30 | 0.1 | 0.7 | 822 | 50.5 | ○ |
| | 3 | 2.94 | 0.56 | 1.0 | 5.25 | 10 | 0.3 | 1.2 | 809 | 50.0 | ○ |
| | 4 | 2.26 | 0.54 | — | 4.19 | 30 | <0.1 | 0.5 | 810 | 51.1 | ○ |
| | 5 | 3.10 | 0.58 | — | 5.34 | 10 | 0.2 | 1.0 | 805 | 50.2 | Δ |
| | 6 | 2.23 | 0.55 | — | 4.05 | 50 | <0.1 | 0.4 | 808 | 52.2 | Δ |
| | 7 | 2.25 | 0.41 | 0.1 | 5.49 | 50 | 0.1 | 0.5 | 801 | 50.9 | ○ |
| | 8 | 3.10 | 0.70 | 0.1 | 4.43 | 10 | 0.5 | 2.0 | 800 | 50.3 | ○ |
| COMPARATIVE EXAMPLE | 9 | 2.02 | 0.48 | — | 4.21 | 50 | <0.1 | 0.4 | 733 | 50.5 | ○ |
| | 10 | 2.83 | 0.75 | — | 3.77 | 30 | 0.4 | 1.0 | 788 | 47.7 | Δ |
| | 11 | 3.70 | 0.67 | — | 5.52 | 10 | 1.0 | 5.0 | 762 | 42.5 | X |
| | 12 | 2.83 | 0.67 | 0.5 | 4.22 | 100 | 0.1 | 2.0 | 782 | 49.1 | ○ |
| | 13 | 2.83 | 0.67 | 0.5 | 4.22 | 5 | 0.7 | 4.0 | 789 | 50.1 | Δ |

In Table 1, samples of copper alloys manufactured by the manufacturing method according to the present invention are numbered "1" to "8", and samples of copper alloys prepared as comparative examples, which are composed of materials each in a different amount from that according to the present invention or manufactured by a different manufacturing method from the method according to the present invention, are numbered "9" to "13".

Also, in Table 1, the respective properties and the respective evaluation results of the samples of copper alloys are indicated by respective proportions (percent by mass) of Ni, Si, and Zn in the copper alloy, a mass ratio of Ni to Si, a cooling rate (° C./h) after aging, a volume ratio (%) of inclusions to the copper alloy, the maximum size (μm) of the inclusions, tensile strength (MPa), conductivity (% IACS), and plating adhesion. Additionally, though an amount of copper which is a main material for the copper alloy is not shown in Table 1, the amount of copper can be easily estimated from the amounts of the other components shown in Table 1.

With respect to plating adhesion, it is noted that a bending test is carried out on each of the samples, in which each of the samples is bent into 180 degrees and is again bent in the opposite direction, and the state of a plating is observed. A sample which receives no damage to a plating thereof is evaluated to have excellent plating adhesion and marked "○", a sample from which plating is peeled off is evaluated to have poor plating adhesion and marked "X", and a sample which receives damage to a plating thereof though the plating is not peeled off is evaluated to have average plating adhesion and marked "Δ".

It is appreciated from Table 1 that each of the copper alloy samples Nos. 1, 2, 3, 4, 5, 6, 7, and 8 has tensile strength equal to or higher than 800 MPa ($N/mm^2$) and conductivity equal to or higher than 50% IACS.

It is also appreciated from Table 1 that each of the copper alloy samples Nos. 2, 3, 7, and 8 in which Zn is added, and each of the copper alloy samples Nos. 1 and 4 in which the mass ratio of Ni to Si is suitable and the maximum size of the inclusions and the volume ratio of the inclusions are small, exhibits excellent plating adhesion. It is noted that with respect to each of the copper alloy samples Nos. 5 and 6 in which the mass ratio of Ni to Si is close to the upper limit or the lower limit of the range prescribed for the copper alloy according to the present invention, though the plating adhesion thereof is not excellent, the plating is not peeled off.

Further, though each of the copper alloy samples Nos. 1, 4, 5, and 6 does not contain Zn, each of the copper alloy samples Nos. 1 and 4, other than the copper alloy samples Nos. 5 and 6, exhibits excellent plating adhesion.

Moreover, with respect to each of the copper alloy samples Nos. 3, 5, and 8 in which the cooling rate after aging is set at 10° C./h that is equal to the lower limit of one of the conditions for the manufacturing method according to the present invention, the maximum size of the inclusions therein is equal to or larger than 1 μm, being relatively large as compared to those in the other copper alloy samples according to the present invention. However, the maximum size of the inclusions in each of the copper alloy samples 3, 5, and 8 is smaller than 2 μm.

On the other hand, the copper alloy sample No. 9 prepared as one of the comparative examples contains a smaller amount of Ni than that in conditions for the composition of the copper alloy according to the present invention. Thus, $Ni_2Si$ crystals are insufficiently precipitated out, so that high tensile strength (equal to or higher than 800 MPa) cannot be achieved.

The copper alloy sample No. 10 contains an excessive amount of Si in light of the conditions for the composition of the copper alloy according to the present invention. Thus, while the tensile strength thereof is relatively satisfactory, the conductivity and the plating adhesion thereof are unsatisfactory because an undesired crystalline phase is produced due to excess Si.

The copper alloy sample No. 11 contains an excessive amount of Ni in light of the conditions for the composition of the copper alloy according to the present invention. Thus, an undesired crystalline phase is produced due to excess Ni, so that none of the tensile strength, the conductivity, and the plating adhesion is satisfactory.

With respect to each of the copper alloy samples Nos. 12 and 13, the amount of Ni, Si, or Zn and the mass ratio of Ni to Si are equal to those in the copper alloy sample No. 2, to meet the conditions for the composition of the copper alloy according to the present invention. Nonetheless, the respective cooling rates after aging of the copper alloys samples Nos. 12 and 13 are set at 100° C./h and 5° C./h, which are out of the range of 10 to 50° C./h prescribed in the conditions for the manufacturing method according to the present invention.

Accordingly, the copper alloy sample No. 12 has the tensile strength and the conductivity which are lower than those of the copper alloy sample No. 2, and the copper alloy sample No. 13 has the tensile strength which is lower than that of the copper alloy sample No. 2.

In the copper alloy sample No. 13 which is cooled after aging at the cooling rate lower than 1I0C/h, the maximum size of the inclusions is 4.0 μm. Additionally, the volume ratio of the inclusions of the copper alloy sample No. 13 is 0.7%, being the highest in all the copper alloy samples in Table 1.

Analysis made by the inventors of the present invention based on the above-described results clarified that when the cooling rate was higher than 50° C./h, each of tensile strength and conductivity was low because of insufficient precipitation of $Ni_2Si$, and when the cooling rate was lower than 10° C./h, both of tensile strength and plating adhesion were unsatisfactory because an $Ni_2Si$ crystalline phase and inclusions to become coarse.

<E. Conclusion>

As is made clear from the experimental results shown in Table 1 and described above, when a copper alloy contains Ni of 2.2 to 3.2 percent by mass and Si of 0.4 to 0.8 percent by mass, the mass ratio of Ni to Si is controlled to be in a range of 4.0 to 5.5, and the cooling rate after aging is controlled to be in a range of 10 to 50° C. per hour, the size of each of the inclusions precipitated out in the copper alloy can be kept equal to or smaller than 2 μm and the total volume of the inclusions each of which is in the range of 0.1 to 2 μm in size can be kept equal to or smaller than 0.5% of the total volume of the copper alloy. Thus, it is possible to obtain a copper alloy having tensile strength equal to or higher than 800 MPa and conductivity equal to or higher than 50% IACS.

It is additionally noted that each of the numerical ranges cited in the above description is derived from the upper limit and the lower limit of each of items shown in Table 1, with a tolerance of ±approximately 0 to 10%. It has been confirmed that the desired values can be achieved even with such a tolerance.

While the invention has been shown and described in detail, the foregoing description is in all aspects illustrative and not restrictive. It is therefore understood that numerous modifications and variations can be devised without departing from the scope of the invention.

What is claimed is:

1. A copper alloy comprising:

Ni in an amount of 2.2 to 3.2 percent by mass;

Si in an amount of 0.4 to 0.8 percent by mass;

Cu and an unavoidable impurity, wherein a mass ratio of said Ni to said Si is in a range of 4.0 to 5.5, and a size of an inclusion precipitated in said copper alloy is equal to or smaller than 2 μm, and a total volume of said inclusion precipitated which is 0.1 to 2 μm in size is smaller than 0.5% of a total volume of said copper alloy, wherein said copper alloy has a tensile strength equal to or higher than 800 MPa.

2. The copper alloy according to claim 1, further comprising Zn of 0.1 to 1.0 percent by mass.

* * * * *

UNITED STATES PATENT AND TRADEMARK OFFICE

CERTIFICATE OF CORRECTION

PATENT NO. : 7,413,619 B2
APPLICATION NO. : 11/357153
DATED : August 19, 2008
INVENTOR(S) : Kawahata et al.

It is certified that error appears in the above-identified patent and that said Letters Patent is hereby corrected as shown below:

Column 8, line 30, change "1I0C/h" to --10°C/h--.

Signed and Sealed this

Twenty-third Day of December, 2008

JON W. DUDAS
*Director of the United States Patent and Trademark Office*